US005257954A

United States Patent [19]

Mullisen et al.

[11] Patent Number: 5,257,954

[45] Date of Patent: Nov. 2, 1993

[54] RESCUE BUOY PACKAGE

[75] Inventors: Ronald S. Mullisen, Los Osos, Calif.; Gregory G. Steiner, 6790 Avila Valley Dr., San Luis Obispo, Calif. 93405

[73] Assignee: Gregory G. Steiner, San Luis Obispo, Calif.

[21] Appl. No.: 5,751

[22] Filed: Jan. 19, 1993

[51] Int. Cl.[5] ..... B63C 9/22

[52] U.S. Cl. ..... 441/89; 441/92; 441/118; 441/17; 441/23; 441/29

[58] Field of Search ..... 441/6, 11, 16, 17, 18, 441/21, 23, 28, 29, 30, 31, 80, 88, 89, 90, 92, 93, 95, 117, 118; 114/190; 116/20

[56] References Cited

U.S. PATENT DOCUMENTS 4,498,879 2/1985 Burr ..... 441/80

4,668,200 5/1987 Kotoh et al. ..... 441/11

*Primary Examiner*—Sherman Basinger

*Attorney, Agent, or Firm*—Daniel C. McKown

[57] ABSTRACT

A rescue buoy package for use on a boat for marking the location of a person overboard and for remaining in that location until help can arrive includes an outer cylindrical tube that is mounted within arm's reach of the ship's helm and an inner cylindrical tube that fits into the outer tube and to which a heavily weighted cap is affixed. The cap extends downwardly over the open upper end of the outer tube keeping the contents dry and secure. The contents include an inflatable mast and a vest-type flotation device. The buoy can be packaged in a normal mode in which it must be deployed manually or in a second mode in which deployment is automatic. In the normal mode the buoy is deployed by pulling upwardly on a knob on the cap to remove the inner tube, the mast and the flotation device from the outer tube, and throwing the inner tube and its affixed cap into the water along with the mast and flotation device. If the second mode has been chosen, the buoy will automatically deploy, but only in the event of a capsize. The mast inflates immediately through the action of a water-activated valve, and the flotation device, which is connected to the mast by a line serves as a sea anchor to minimize wind-caused drift of the buoy. After use, the buoy can be repackaged.

5 Claims, 3 Drawing Sheets

RESCUE BUOY PACKAGE

BACKGROUND OF THE INVENTION

1. Field of the Invention

The present invention is in the field of marine safety equipment and in particular relates to a buoy that can be used to mark the location of a person who has fallen overboard from a boat so that the boat can turn around and return to rescue the person.

2. The Prior Art

There is a well-developed art relating to buoys and associated rescue gear, because the problem they solve is quite old.

Typical of the current state of the art are the Man Overboard Modules manufactured and sold by Survival Technologies Group. Their mark VII module includes an inflatable vest-type flotation device, an inflatable raft, a sea anchor, and a pylon. These items are stowed in a canister prior to use.

In U.S. Pat. No. 4,224,707 issued Sep. 30, 1980 to Mariani, there is shown a marker buoy that contains an inflatable standard.

A telescopic pole for marking the position of a man overboard is described in U.S. Pat. No. 3,760,441 issued Sep. 25, 1973 to Handelman. The telescopic pole extends from 4 feet in length to 18 feet in length under the action of centrifugal force when a user swings the pole in the process of throwing it into the water.

A marker buoy for use by flyers is described in U.S. Pat. No. 2,470,783 issued May 24, 1949 to Mead. The buoy is secured to the airplane's fuselage and is released in response to hydrostatic pressure.

In U.S. Pat. No. 4,475,476 issued Oct. 9, 1984 Howard shows a signal device consisting of a vividly colored inflatable tube that is permanently attached to a life jacket.

Buoys for marking the location of a diver are described in U.S. Pat. No. 4,123,813 issued Nov. 7, 1978 to Adams and in U.S. Pat. No. 3,149,352 issued Sep. 22, 1964 to Christiansen.

From the above patents, it is apparent that most of the components for a rescue buoy are highly developed, such as inflatable masts, flotation vests, water-activated valves, etc.

Nevertheless, these components may never have an opportunity to serve their purpose if they are not properly packaged and instantly available for use on the boat. Thus, it is the packaging of these components that is the subject of the present invention, and the present invention is a very effective way of packaging those components.

SUMMARY OF THE INVENTION

It is an objective of the present invention to provide a novel and more effective way of packaging the components used in a rescue buoy.

The packaging used in the present invention results in a number of significant advantages. Compared to existing packages, the package of the buoy of the present invention is remarkably small. A major problem with existing equipment is that, on smaller boats the size of the package discourages the use of a buoy or other safety equipment. For example, a typical man overboard pole may be 15 feet long and therefore not conveniently mountable on a small boat. The Man Overboard Module referred to above is mounted on the outboard side of the stern of the boat. Assuming, as is common, that there are initially two men onboard and one falls over, the man remaining onboard must leave the helm of the boat and run to the stern to deploy the Module. In contrast, the packaged buoy of the present invention is small enough that it can be mounted within easy reach of the helm of the boat so that the remaining crewman does not have to leave the helm to deploy the buoy.

A second advantage that results from the packaging of the buoy in the present invention is that is can be deployed with a single motion of one hand, leaving the other hand free to maintain a grip on the helm or on a railing. It is necessary only to grasp the knob on the top of the package and in a single motion lift the buoy and throw it into the water. This can be done in a few seconds.

A third advantage of the packaging is its cylindrical shape that permits it to be mounted easily to any appropriate surface.

A fourth advantage is that the package permits the user to select an automatic deployment mode in which, if the boat capsizes, the buoy will deploy automatically. This makes the buoy useful in situations where a boat is manned by only one person.

Another advantage that flows from the packaging design of the buoy of the present invention is that it is repackable by the boater, and most of the components are reusable.

In accordance with the present invention, the buoy package includes an outer tube that is secured to the boat and an inner tube that fits within the outer tube and that is affixed at one end to a cap that fits down over the outer tube. The cap is weighted, and when the buoy is deployed, the weighted cap becomes its lowest part, serving to stabilize the buoy in an upright position. The inner tube serves as the rigid body of the buoy, and the outer tube remains attached to the boat.

The inner tube includes a reservoir of compressed gas and a water-activated valve. When the valve is contacted by the water, it releases the compressed gas into the inflatable mast that extends from the end of the inner tube that is opposite the weighted cap. In this way, the length of the inner tube adds to the length of the buoy and allows the ballast weight contained in the cap to rest lower in the water than it would if the inner tube were shorter.

The inflatable mast is constructed of a pliable material and initially is stowed in the space between the outer tube and the inner tube.

The inner tube does not extend all the way to the bottom of the outer tube, and this leaves room for storing an inflatable vest-type flotation device at the bottom of the outer tube. The inflatable vest flotation device is connected by a line to a point along the inflatable mast.

In a preferred embodiment, the inflatable vest-type flotation device is used as a sea anchor to reduce the tendency of the buoy both to drift and to lean over in response to wind. This is accomplished by use of a harness consisting of four lines that are connected to four points spaced around the perimeter of the flotation vest and that are connected at their other end to a single line that runs to the inflatable mast. Two small weights are connected to the flotation vest to stabilize it in the water.

Although inflation of the mast occurs automatically, the man overboard must inflate the flotation device, and once it has been inflated, it no longer functions as a drag anchor.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
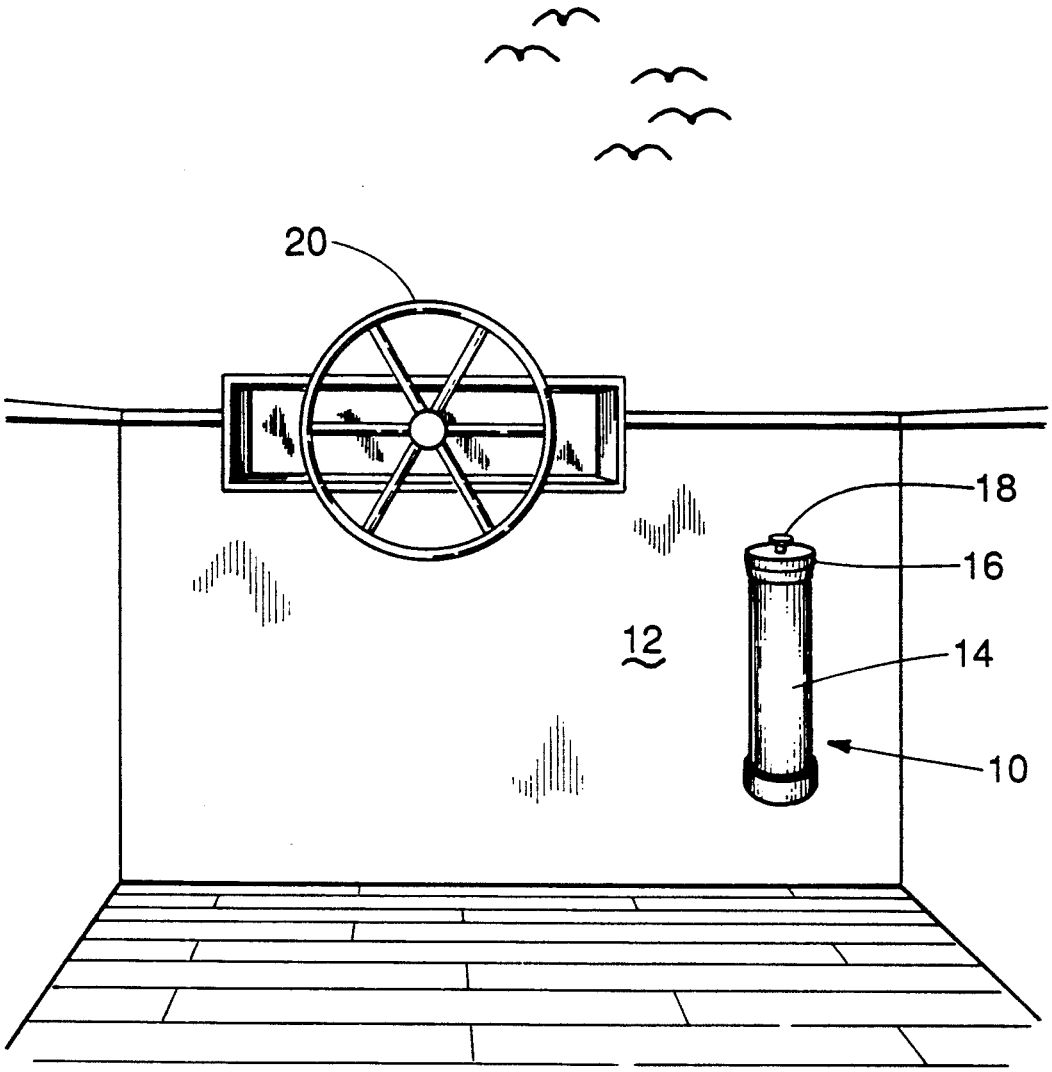
FIG. 1 is a perspective view showing the rescue buoy package as it would typically be installed on a boat, ready for use.

As shown in FIG. 1, the rendezvous rescue buoy package 10 is mounted to a bulkhead 12 within arm's reach of the helm 20. This permits the buoy to be deployed by only one person who does not have to leave his position at the helm 20, and, in fact, can deploy the buoy 10 with one hand while holding the helm 20 with the other hand.

The outer tube 14, the cap 16 and its knob 18 can be seen in FIG. 1.

The overall dimensions of the packaged buoy are approximately 50 cm in length and approximately 13 cm in diameter.

Figure 2:
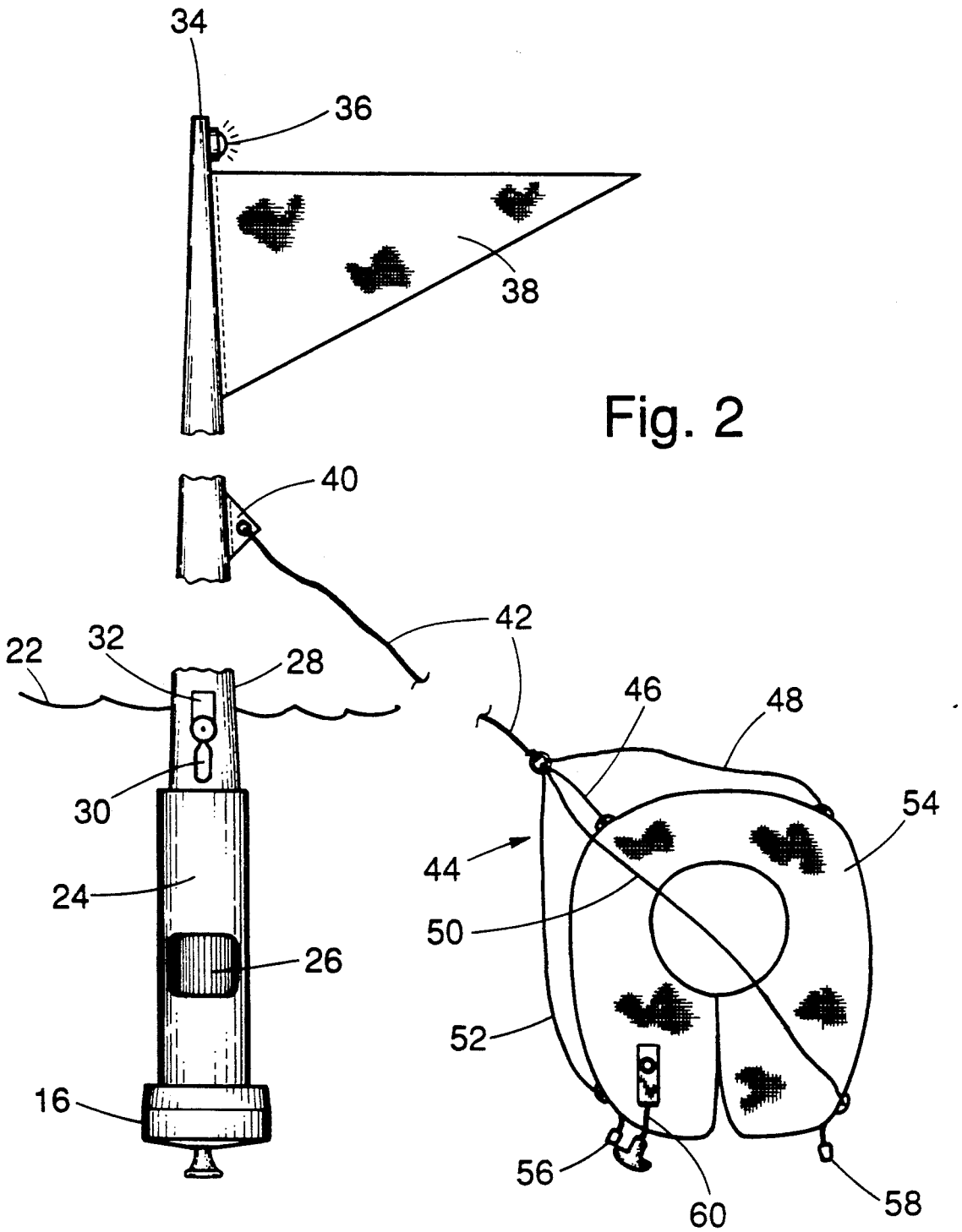
FIG. 2 is a side elevation view showing the rescue buoy after it has been deployed.

FIG. 2 shows the rendezvous rescue buoy of the present invention after it has been deployed. Of its total height of 2.74 meters, approximately 2.03 meters are above the surface 22 of the water while the remaining 0.71 meters are below the surface of the water.

The buoy is very stable in the water, largely because most of its weight is concentrated in the weighted cap 16 that is deliberately located at the lower end of the buoy. The inner tube 24 includes an aperture 26 that causes it rapidly to fill with water, which further adds to the ballast.

After deployment, as shown in FIG. 2, the inner tube 24 assumes an inverted position compared to its predeployed position shown in FIG. 1.

The mast 28 is attached to the inner tube 24 by means of an adhesive as well as by a line tied through the tube 24 and the bottom of the mast. The mast 28 is composed of a pliable material, such as a plastic or rubberized fabric. A reservoir 30 of pressurized gas inflates the mast. This operation is initiated by the water-activated valve 32, which, upon becoming immersed in water opens a path between the reservoir 30 and the interior of the mast 28. At its top end 34, the mast is provided with a pennant 38 and with an electric lamp 36 that is powered by a water-activated battery (not shown) that is stowed in the inner tube 24.

A tab 40 attached to the mast 28 provides a way of attaching one end of the line 42 to the mast 28.

The line 42, which is approximately 3.0 meters long is connected at its other end to the harness 44 that consists of the four lines 46, 48, 50, and 52. These latter lines are connected to a vest-type flotation device 54 at spaced points around its perimeter.

The flotation device 54 is also provided with weights 56, 58 that cause it to assume an upright position in the water.

The flotation device 54 is not inflated when the buoy is deployed, so that it can serve as a sea anchor to reduce wind-caused drift and maintain the buoy upright.

As soon as possible, the person overboard locates and seizes the flotation device and after putting it on, inflates it by pulling on the lanyard 60.

Figure 3:
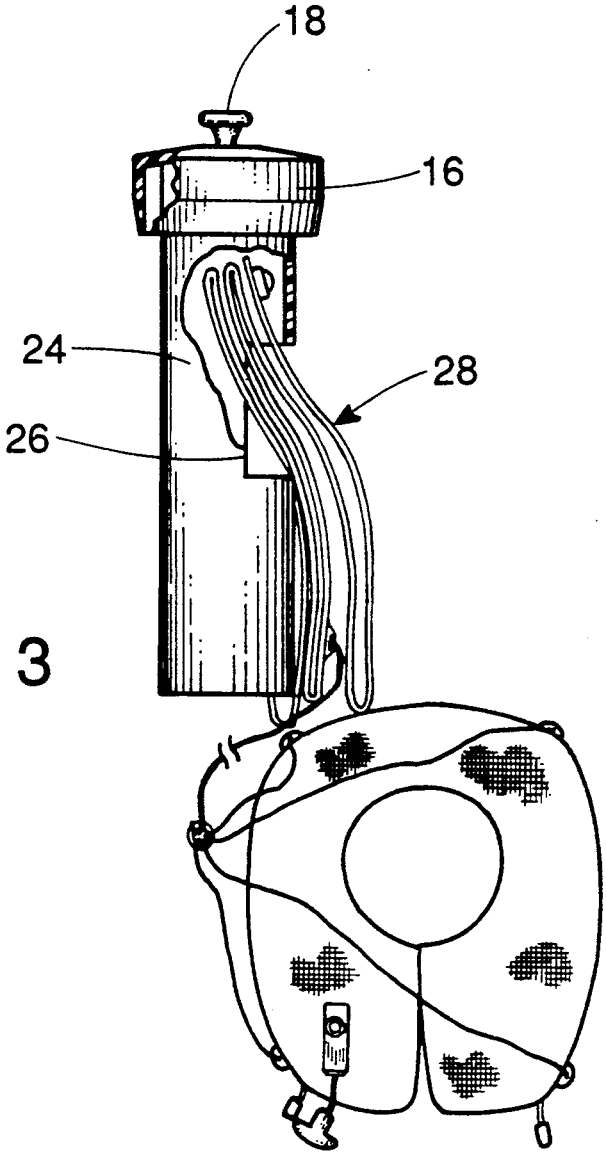
FIG. 3 is a side elevational view showing the inner tube and its contents removed from the outer mounting tube of the rescue buoy; and, FIG. 4 is a side elevational view showing one stage in assembling the rescue buoy.

Now that the general operation of the buoy has been described, the packaging of the components will be described in connection with FIGS. 3 and 4.

When the cap 16 is seated on the outer tube 14 as shown in FIG. 1, the lower end of the inner tube 24 is spaced approximately 11.4 cm from the inside bottom of the outer tube 14. The flotation device 54 occupies this space when the buoy is packed. the reservoir 30 and water-activated valve 32 along with a portion of the mast 28 are inside the inner tube 24, but most of the mast 28 is located in the space between the cylindrical walls of the inner tube 24 and the outer tube 14.

When packaged, the vest is attached to the base of the mast with a strap of hook and loop fastener around the deflated mast. This keeps the vest package with the inner tube and mast so the whole unit can be easily thrown to the person in the water. When the mast inflates, the hook and loop fastener is released and the vest is deployed to act as a sea anchor.

In the preferred embodiment, the inner tube 24 and the outer tube 14 are made of PVC (polyvinyl chloride) plastic pipe.

A weight of several kilograms is included inside the inner tube 24 at the end adjoining the cap 16.

In a first mode of packing the buoy, used when automatic deployment of the buoy is desired, the mast 28 is arranged so that the cap 16 fits over the outer tube 14 in a smooth sliding fit. The heavy weight included at the cap end of the inner tube 24 assures that the inner tube will not leave the outer tube 14 under normal conditions, where the tube 14 is mounted vertically with cap 16 at the top. However, if the ship capsizes and the package is inverted, the great weight at the cap end of the inner tube will cause the inner tube to slide out of the outer tube 14 thereby automatically initiating deployment of the buoy without human intervention.

Figure 4:
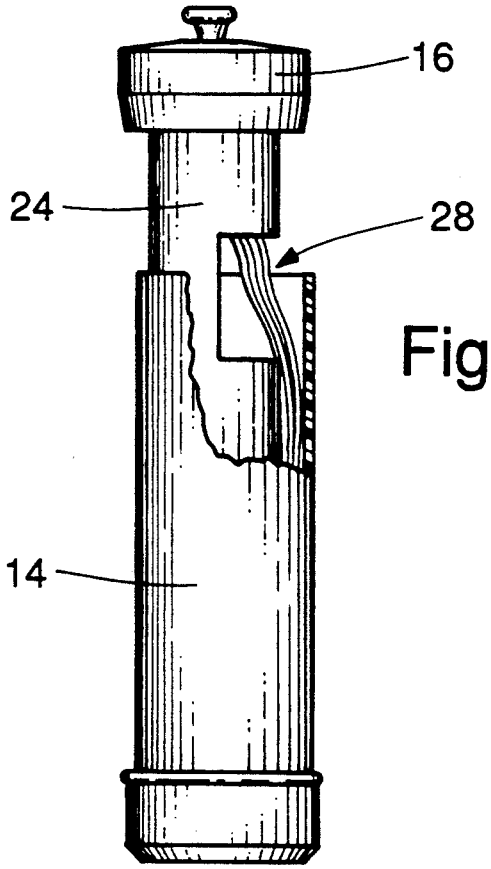

In a second mode of packing the buoy, which will not result in automatic deployment, the mast 28 is arranged mostly on one side of the inner tube 24 as shown in FIG. 4. This causes the inner tube 24 to assume an angle with respect to the outer tube 14. In turn, this causes the cap 16 to be cocked on the outer tube 14 with a considerable increase in friction between the cap and the outer tube 14. The friction is sufficiently great that, even when the package is inverted, the inner tube does not withdraw from the outer tube 14. In this second mode of packing the buoy, the friction assures that the buoy will not deploy, even in the roughest of seas, unless a crew member deliberately deploys it.

Regardless of which packing mode is employed, the user can always pull upward on the knob 18 to withdraw the inner tube 24 from the outer tube 14. With a single motion of his arm, the user then throws the cap 16 and inner tube 24 in the general direction of the person overboard.

Initially, the package sinks in the water, but when the water-activated valve 32 becomes immersed, the mast 28 is inflated very rapidly under water, and its buoyancy causes the package to rise to the surface with the inner tube 24 inverted, and the weighted cap at the bottom, as shown in FIG. 2.

Thus there has been described a rescue buoy package for use on a boat, for marking the location of a man overboard both day and night. The rescue buoy of the present invention can be deployed by one person using only one hand, and deployment takes approximately three seconds. The rescue buoy of the present invention provides flotation for the man overboard in the form of a vest-type flotation device. The vest-type flotation device also serves as a sea anchor to prevent the marker from blowing away from the man overboard.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A rescue buoy package for use on a boat in marking the location of a person or object overboard to facilitate locating the person or object at a later time, comprising in combination:

an outer tube including a cylindrical side wall, having a lower end that is closed and an upper end that is open;

an inner tube including a cylindrical side wall having an aperture, having an outside diameter that is substantially less than the inside diameter of said outer tube so that a subtantial space is included between said inner tube and said outer tube, said inner tube having an upper end and a lower end;

a cap affixed to said inner tube at its upper end and fitting down over an upper end portion of said outer tube to make a snug slidable fit with the cylindrical side wall of said outer tube, said cap including a knob and including a ballast weight;

an inflatable mast of a pliable material attached to said inner tube near its lower end so as to form a rescue buoy therewith, said inflatable mast stowed folded in the space between said inner tube and said outer tube, and oriented to extend out from the lower end of said inner tube when inflated;

a reservoir of a compressed gas;

a water-activated valve connecting said reservoir to said inflatable mast, said reservoir and said water-activated valve contained within said inner tube;

said inflatable mast having sufficient volume when inflated to cause the rescue buoy to float with part of the inflatable mast submerged and with an upper portion of said mast extending upward above the surface of the water, and with said inner tube inverted and filled with water, the length of said inner tube serving to augment the depth below the surface of the water at which the ballast weight of said cap is maintained, thereby to augment the stability of said inflatable mast;

said inflatable mast, when inflated, forming an integral stiff extension of the said inner tube.

2. The rescue buoy package of claim 1 wherein the lower end of said inner tube is spaced from the lower end of said outer tube.

3. The rescue buoy package of claim 1 further comprising in combination:

an inflatable life vest of a pliable material folded and stowed within said outer tube;

a line attached to said inflatable mast;

a harness connecting said line to more than one point on said inflatable lift vest;

whereby after the rescue buoy has been deployed but before said inflatable life vest has been inflated, said inflatable life vest serves as a sea anchor to reduce wind-caused drift and tilting of said inflatable mast.

4. The rescue buoy package of claim 1 wherein said inflatable mast is folded into a bundle that is thicker than the space between said inner tube and said outer tube so that said inner tube and inflatable mast must be forcibly inserted into said outer tube during assembly of the rescue buoy package, thereby forcing said inner tube out of alignment with said outer tube and causing said cap to become slightly cocked on said outer tube, whereby a substantial force must deliberately be applied to withdraw said inner tube from said outer tube.

5. The rescue buoy of claim 1 wherein said inflatable mast further comprises in combination an electric lamp located near the tip of said inflatable mast.

* * * * *